United States Patent [19]

Martin

[11] 4,088,422

[45] May 9, 1978

[54] FLEXIBLE INTERSTAGE TURBINE SPACER

[75] Inventor: Jack Reid Martin, Bedford, Mass.

[73] Assignee: General Electric Company, Lynn, Mass.

[21] Appl. No.: 728,525

[22] Filed: Oct. 1, 1976

[51] Int. Cl.[2] ..... F01D 5/06

[52] U.S. Cl. ..... 416/198 A; 416/201 R; 415/173 R

[58] Field of Search ..... 416/198, 198 A, 200 A, 416/201, 95; 415/172 A, 172 R, 173 A, 173 R

[56] References Cited

U.S. PATENT DOCUMENTS

| | | | |
|---|---|---|---|
| 2,619,317 | 11/1952 | Traupel | 416/200 A X |
| 3,295,825 | 1/1967 | Hall | 416/198 A X |
| 3,304,052 | 2/1967 | Warner et al. | 416/198 A X |
| 3,841,792 | 10/1974 | Amos | 416/198 A X |

FOREIGN PATENT DOCUMENTS

| | | | |
|---|---|---|---|
| 996,504 | 12/1951 | France | 416/201 |
| 1,145,755 | 10/1957 | France | 416/201 |
| 468,862 | 2/1952 | Italy | 416/198 A |
| 223,615 | 12/1942 | Switzerland | 416/198 A |
| 629,770 | 9/1949 | United Kingdom | 416/198 A |

*Primary Examiner*—Everette A. Powell, Jr.
*Attorney, Agent, or Firm*—Henry J. Policinski; Derek P. Lawrence

[57] ABSTRACT

An interstage spacer for the turbine section of a gas turbine engine is provided with a flexible bellows which absorbs axial growth of the adjacent turbine stages to prevent seizing and binding.

6 Claims, 2 Drawing Figures

12
26
24
10
8
25
4
3
6
14
16
2
18
20
22
23
ENGINE CENTERLINE

FLEXIBLE INTERSTAGE TURBINE SPACER

BACKGROUND OF THE INVENTION

The invention herein described was made in the course of or under a Government contract or subcontract thereunder (or grant) with the United States Air Force.

The present invention relates to improvements in gas turbine engines and more particularly to a novel interstage spacer for the multi-stage turbine section of a gas turbine engine which exhibits improved performance and reliability.

Multi-stage turbines generally include spacing devices between the stages to maintain a predetermined spacing between turbine stages and to provide an interstage seal to prevent leakage of the gas compressed by the preceding stage. A typical prior art interstage spacer is shown in FIG. 1. The interstage spacer 2 includes at its outside diameter an axially extending flange 3 having at opposed ends thereof a pair of rabbet teeth 4 and 6. Teeth 4 and 6 abut the flanges 8 and 10 which extend axially from the end sealing plates 12 and 14 mounted on respective adjacent turbine disks 16 and 18. The seal provided by the teeth 4 and 6 abutting the respective flanges 8 and 10 prevents leakage of the gases passing between the turbine stages 16 and 18. The spacer 2 further includes a shank portion 20 which extends radially inward terminating in a pair of axially extending flanges 22 and 23 which are bolted to the hub portion of the disks 16 and 18. The spacer 2 further includes along its outside diameter a plurality of labyrinth teeth 24 in rotating engagement with a seal runner 25 formed integral with an accelerator 26 to provide a rotating seal for the accelerator 25.

Spacers of this type have exhibited several problems in maintainability and reliability. Many of these problems result from the tensile forces which are imposed on the spacer during operation of the turbine. These forces result primarily from the uneven temperature distribution across the spacer. Thus, the outside diameter of the spacer which is in greater proximity to relatively hot gases exiting the combustor (not shown) operates at temperatures much greater than the inside diameter of the spacer. Temperature gradients as high as 400° are experienced between the outside diameter and inside diameter portions of the spacer 2. This uneven temperature distribution causes the outside diameter portion of spacer 2 to pull away from the bolted inside diameter portion thereof resulting in relatively large tensile forces in the spacer. These tensile forces significantly increase the life cycle fatigue of the spacer 2 and thereby significantly reduces its reliability. These tensile forces also tend to propagate any cracks which may develop in the spacer 2, further reducing its reliability.

Another problem associated with such prior art spacers is that the seal formed between the rabbet teeth 4 and 6 and the respective flanges 8 and 10 is very resistant to sliding friction at the relatively high temperatures at which this portion of the turbine operates. However, because of the axial growth of the spacer 2 and turbine disks 16 and 18, at these relatively high operating temperatures, the rabbet teeth 4 and 6 are subject to sliding friction. The resistance of the rabbet teeth 4 and 6 to sliding friction may result in seizing of the spacer at the rabbet teeth 4 and 6 generating axial loads which can pry the cooling plates 12 and 14 away from their respective disks 16 and 18.

Several solutions to these problems have been promulgated in the past. Most of the proposed solutions have been directed to spacers which provide some degree of axial flexibility. However, none of these prior art spacers have proven to be effective when there is also a requirement that an end sealing plate remain in contact with the spacer such as when both stages must be air cooled. Further, many of the prior art spacers are of a design which permit them to go out of round thereby reducing the sealing effectiveness of the labyrinth teeth disposed thereon.

OBJECT OF THE INVENTION

It is therefore a primary object of the present invention to provide an interstage spacer for a multi-stage turbine which exhibits improved reliability and performance.

It is a further object of this invention to provide an improved interstage spacer for a multi-stage turbine which absorbs axial growth of the turbine stages without binding or seizing.

It is a further object of this invention to provide an improved interstage spacer for a multi-stage turbine which does not exhibit high tensile loading in operation.

It is still a further object of this invention to provide an improved interstage spacer for a multi-stage turbine which may be used with turbine disks which employ end sealing plates or similar construction for air cooling and sealing.

SUMMARY OF THE INVENTION

These and other objects are achieved in the preferred embodiment of this invention in which the multi-stage turbine section of a gas turbine engine is provided with a novel and improved spacer. The spacer comprises a hollow disk having at its outside diameter an axially extending flange portion including a plurality of labyrinth teeth disposed thereon. The outer ends of the flange are tapered to form rabbet teeth for sealing engagement with corresponding axially extending flanges on respective cooling plates on the turbine disks. In order to provide axial flexibility the innermost labyrinth teeth are separated by a flexible bellows which extends radially inward beyond the flange. The spacer is not bolted to the turbine disks but is allowed to ride freely on the axially extending flanges of the disks. A separate ring coupler is provided to join the hub of the turbine disks.

Because the spacer is not bolted to the disk sections it does not experience tensile forces due to the difference in operating temperatures of its outside diameter and inside diameter portion. This improves life cycle fatigue and prevents crack propagation thereby significantly increasing the reliability of the spacer. The axial flexibility created by the bellows prevents sliding friction at the rabbet seal due to thermal expansion of the disks and thereby prevents seizing and binding of the seal which tends to pull the cooling plates away from the disk.

BRIEF DESCRIPTION OF THE DRAWINGS

The invention may be better understood upon reading the following description of the preferred embodiment in conjunction with the accompanying drawings in which.

DESCRIPTION OF THE PREFERRED EMBODIMENT

Figure 1:
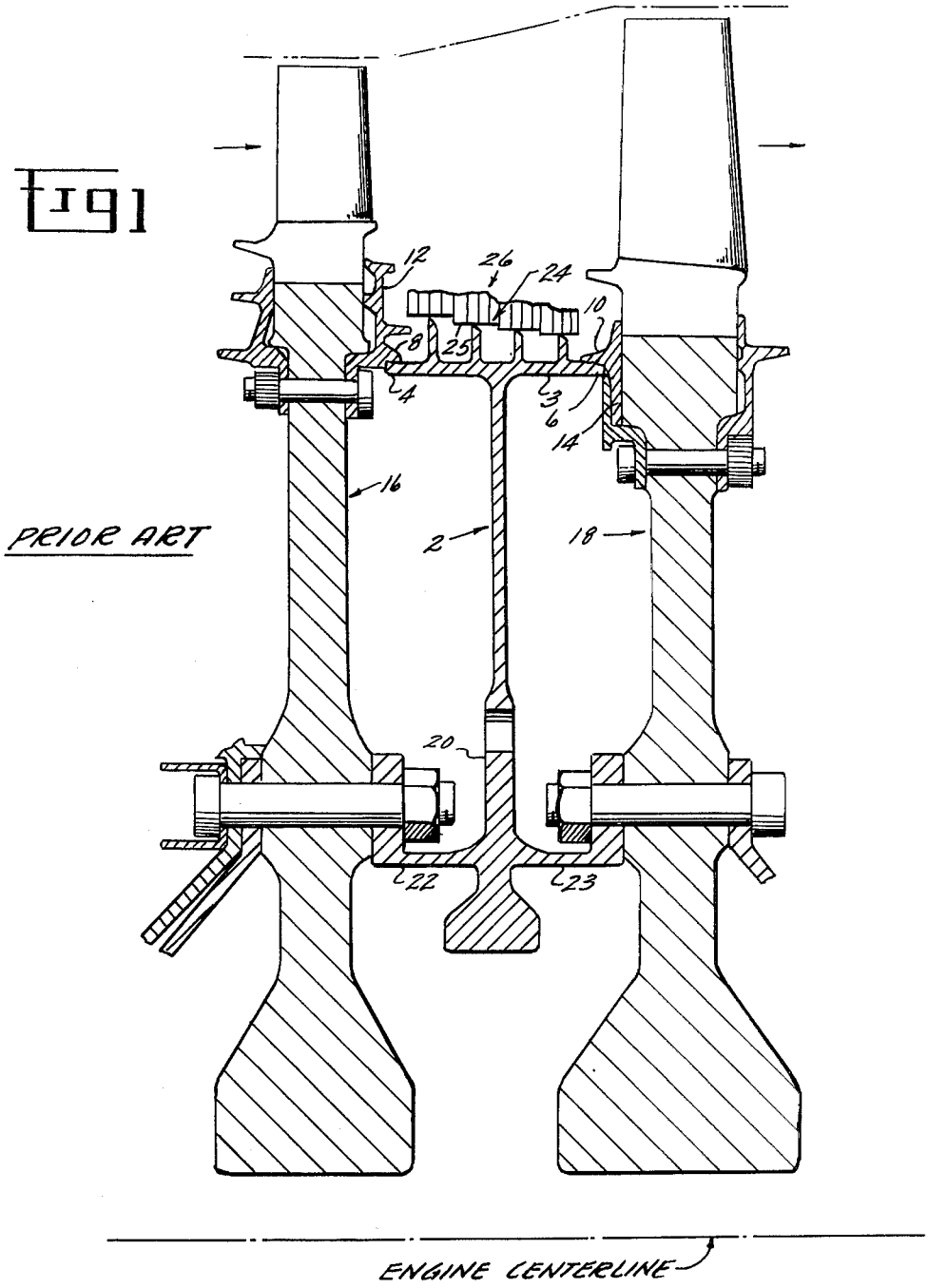
FIG 1 PRIOR ART
FIG. 1 is a cross-sectional view of a prior art interstage turbine spacer.
Figure 2:
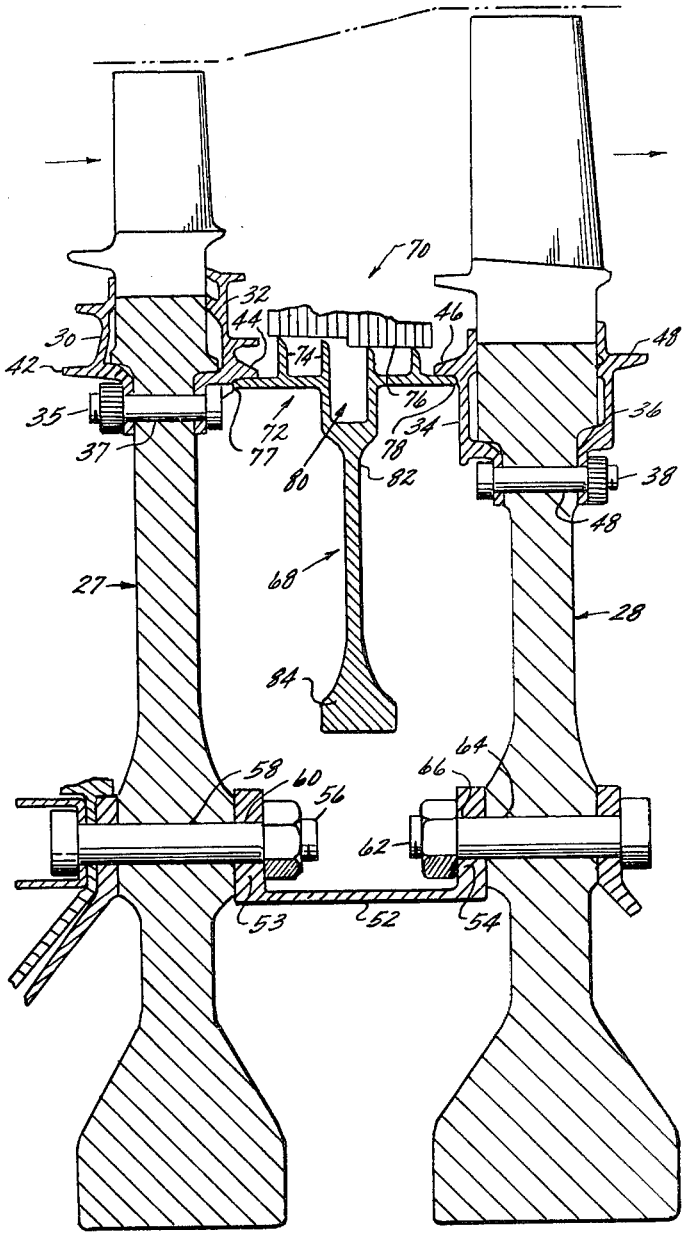
FIG. 2 is a cross-sectional view of the interstage turbine spacer of this invention.

Referring to FIG. 2 there is shown two adjacent turbine disks 27 and 28 of a multi-stage turbine section for a gas turbine engine. The rim portion of each disk 27 and 28 includes a pair of end sealing plates 30 and 32 abutting opposite ends of disk 27 and end sealing plates 34 and 36 abutting opposite ends of disk 28. The sealing plates 30 and 32 are compressed against opposing ends of the disk 27 by a plurality of bolts 35 extending through a circle of bolt holes 37 in the neck portion of the disk 27. The sealing plates 34 and 36 are compressed against opposing ends of the disk 28 by a plurality of bolts 38 extending through a circle of bolt holes 48 in the neck portion of the disk 28. The sealing plates 30, 32, 34 and 36 include respective axially extending flanges 42, 44, 46 and 48. In accordance with the present invention the disks 27 and 28 are joined at their hub to a ring coupler 52 having radially outward extending flanges 53 and 54 at its outside diameter. The flange 53 is bolted to the hub of the disk 27 by a plurality of bolts 56 extending through a circle of bolt holes 58 in the hub portion of the disk 27 and corresponding adjacent holes 60 in the flange 53. The flange 54 is bolted to the hub of the disk 28 by a plurality of bolts 62 extending through a circle of bolt holes 64 in the hub portion of the disk 28 and corresponding adjacent holes 66 in the flange 54.

An annular spacer shown generally at 68 is provided between the disk stages 27 and 28. The spacer 68 seals the blade portions of the disks 27 and 28 against leakage and also provides a labyrinth seal for an adjacent gas accelerator shown generally at 70. The spacer 68 comprises an annular hollow disk which includes an axially extending flange portion shown generally at 72 having a plurality of axially spaced radially inwardly extending labyrinth teeth shown generally at 74 disposed thereon. The teeth 74 are in rotating and sealing engagement with a seal runner 76 formed integral with the accelerator 70. The outer ends of the flange portion 72 are tapered to form rabbet teeth 77 and 78 at opposed ends thereof. Rabbet tooth 77 is disposed in sealing engagement with the axially extending flange 44 on the sealing plate 32 and rabbet tooth 78 is disposed in sealing engagement with the axially extending flange 46 on the sealing plate 34. In order to provide axial flexibility, the innermost labyrinth teeth 74 are separated by a flexible bellows shown generally at 80. The bellows 80 extends radially outward from flange portion 72. The spacer 68 further includes a tapered neck portion 82 which extends radially inward beyond the bellows 80 and flares out into a hub portion 84. The spacer 68 is contoured in this manner in order to optimize the distribution of the stresses created in the spacer during rotation thereof such that the spacer is radially self supporting.

In order to prevent excessive tensile stresses from being developed in the spacer 68, the spacer 68 is not bolted to the respective hub portion of the disks 27 and 28. Rather, the hub portion of the disks 27 and 28 are connected by the ring coupler 52. Because the spacer 68 is not bolted to the disk sections it does not experience tensile forces due to the difference in operating temperatures of its outer and inner diameter. This improves the life cycle fatigue of the spacer and prevents crack propagation therein, thereby significantly increasing the reliability of the spacer 68. The axial flexibility created by the bellow 80 limits the load available to pry the disks apart when the sliding friction at the rabbet teeth 77 and 78 is high due to thermal expansion of the disks and thereby prevents seizing and binding of the spacer 68.

Having described a preferred embodiment of the present invention, though not exhaustive of all equivalents, it will be appreciated by those skilled in the art that many modifications, substitutions and changes may be made thereto without departing from the fundamental theme of the invention. Therefore, what is desired to be secured by Letters Patent is as follows.

What is claimed is:

1. An interstage spacer for a multi-stage turbine comprising a hollow disk disposed intermediate turbine stages, said disk including an axially extending flange portion at its outer diameter which abuts the adjacent turbine stages, said flange portion extending radially inward at a point intermediate the ends thereof to form flexible bellows means for absorbing axial growth of the turbine stages, said spacer further including a neck portion extending radially inward from the flexible bellows means and flaring into a hub portion at the inside diameter of the spacer.

2. The interstage spacer of claim 1 wherein the flange further includes a plurality of axially spaced radially outward extending labyrinth teeth.

3. The interstage spacer of claim 2 wherein the flexible bellows means is disposed intermediate the innermost labyrinth teeth.

4. The interstage spacer of claim 1 wherein the outer ends of the flange are tapered to form rabbet teeth in sealing engagement with respective end sealing plates mounted on the adjacent turbine stages.

5. The interstage spacer of claim 1 further comprising a ring coupler disposed intermediate the turbine stages having a pair of radially outward extending flanges at opposite ends of its inside diameter said flanges adapted to be bolted to the hub of respective adjacent turbine stages.

6. An interstage spacer for a multi-stage turbine comprising:

a hollow disk disposed intermediate turbine stages said disk including an axially extending flange portion at its outside diameter the ends of which are tapered to form rabbet teeth in sealing engagement with respective end sealing plates mounted on the adjacent turbine stages, said flange having a plurality of axially spaced radially outward extending labyrinth teeth in rotating and sealing engagement with a seal runner formed integral with a gas accelerator and wherein the spacer extends radially inward from the flange portion at a point intermediate the innermost labyrinth teeth to form a flexible bellows the lower portion of which extends further radially inward to form a tapered neck which flares into a hub at the inside diameter of the spacer, and a ring coupler disposed intermediate the turbine stages radially inward from the hollow disk having a pair of radially outward extending flanges at opposite ends of its inside diameter adapted to be bolted to the hub of the respective adjacent disks.

* * * * *